US009814317B2

(12) United States Patent
Yip

(10) Patent No.: US 9,814,317 B2
(45) Date of Patent: Nov. 14, 2017

(54) FOLDING SEAT

(71) Applicant: Kwai Yip, Hong Kong (HK)

(72) Inventor: Kwai Yip, Hong Kong (HK)

( * ) Notice: Subject to any disclaimer, the term of this patent is extended or adjusted under 35 U.S.C. 154(b) by 130 days.

(21) Appl. No.: 14/935,465

(22) Filed: Nov. 9, 2015

(65) Prior Publication Data

US 2016/0150884 A1 Jun. 2, 2016

(30) Foreign Application Priority Data

Nov. 28, 2014 (CN) ..... 2014 1 0709119

(51) Int. Cl.
*A47C 4/04* (2006.01)
*A47C 1/026* (2006.01)

(52) U.S. Cl.
CPC ..... *A47C 4/04* (2013.01); *A47C 1/026* (2013.01)

(58) Field of Classification Search
CPC .... A47C 4/04; A47C 4/14; A47C 4/24; A47C 1/026; A47C 1/025; A47C 1/024; A47B 3/02; A47B 2003/025; A47B 3/0912; A47B 3/0911
See application file for complete search history.

(56) References Cited

U.S. PATENT DOCUMENTS 1,942,603 A * 1/1934 Johanson ..... A47B 3/02 108/119
2,599,164 A * 6/1952 Cudini ..... A47C 4/24 297/48
2,843,188 A * 7/1958 Spencer ..... A47C 4/24 297/48
2,918,114 A * 12/1959 Hendrickson ..... A47C 4/24 297/55
5,397,168 A * 3/1995 Hand ..... A47C 1/026 297/356
5,511,852 A * 4/1996 Kusiak ..... A47C 1/023 297/298
6,145,930 A * 11/2000 Su ..... A47C 1/026 297/362
6,382,716 B1 * 5/2002 Wu ..... A47C 4/24 108/118

(Continued)

FOREIGN PATENT DOCUMENTS

CN 2678465 Y 2/2005
GB 2209665 A 5/1989

OTHER PUBLICATIONS

Search Report issued by the Chinese Patent Office dated Dec. 16, 2013.

*Primary Examiner* — Timothy J Brindley

(57) ABSTRACT

The present invention provides a folding seat having a seating portion. The seating portion includes a seating panel, a first footstand, a movable stand, a second footstand, a first pull rod and a second pull rod. The upper end of the first footstand is hinged to the seating panel and the movable stand is also hinged to the seating panel. The upper end of the second footstand is hinged to the free end of the movable stand and is thus capable of rotating with regard to the hinged position and in relation to the movable stand. Both ends of the first pull rod are hinged to the first footstand and the movable stand respectively, and both ends of the second pull rod are hinged to the seating panel and the second footstand, respectively.

7 Claims, 7 Drawing Sheets

(56) References Cited

U.S. PATENT DOCUMENTS

| | | | | |
|---|---|---|---|---|
| 6,491,344 | B1 * | 12/2002 | Stumpf | A47C 1/026 297/374 |
| 6,688,694 | B1 * | 2/2004 | Yu | A47C 1/0244 297/354.13 |
| 7,712,422 | B2 * | 5/2010 | Bue | A47B 3/00 108/115 |
| 9,609,943 | B1 * | 4/2017 | Lin | A47B 3/02 |
| 2005/0120922 | A1 * | 6/2005 | Brooks | A47B 3/02 108/118 |
| 2007/0175369 | A1 * | 8/2007 | Reiner | A47B 3/02 108/118 |
| 2010/0293748 | A1 * | 11/2010 | Yamashita | A47C 1/026 16/249 |
| 2011/0043004 | A1 * | 2/2011 | Akkad | A47C 4/24 297/39 |
| 2012/0139310 | A1 * | 6/2012 | Aldred | A47C 3/18 297/311 |
| 2015/0173517 | A1 * | 6/2015 | Chen | A47C 7/402 297/353 |
| 2015/0182016 | A1 * | 7/2015 | Rivera | F16B 2/185 108/123 |
| 2015/0257527 | A1 * | 9/2015 | Lai | A47B 3/0818 108/164 |
| 2015/0327636 | A1 * | 11/2015 | Pao | A47C 4/04 135/66 |
| 2016/0286951 | A1 * | 10/2016 | Chung | A47B 9/16 |
| 2016/0353875 | A1 * | 12/2016 | Lin | A47B 3/02 |
| 2017/0027323 | A1 * | 2/2017 | Probst | A47C 7/402 |

* cited by examiner

FOLDING SEAT

CROSS-REFERENCE TO RELATED APPLICATIONS

The present application claims the benefit of Chinese Patent Application No. 201410709119.6 filed on Nov. 28, 2014, the contents of which are hereby incorporated by reference.

TECHNICAL FIELD

The present invention relates to the field of portable seats, in particular to a folding seat.

BACKGROUND

With continuous increase of the population density, the living area occupied by human beings becomes larger and larger. However, since resources and space are finite, whether the furniture and appliances occupy a large space and whether the functions thereof are diversified become the main points of consideration for home decoration design at present. Traditional chairs occupy a larger spatial size in both horizontal direction and vertical direction. When larger space is needed at home or in office, the traditional chairs must be moved out, causing inconvenience. Further, traditional chairs do not possess the function of adjusting the backrest angle. When the backrest of the chair needs to be adjusted for a better rest or an emergent patient needs to lie flatly in a transporting process, a common chair cannot meet such demands.

Therefore, a folding seat which is adjustable in backrest angle is needed. If necessary, the folding seat can be used as a stretcher by adjusting the angle between the backrest and the seating panel to 180 degrees.

SUMMARY OF THE INVENTION

The present invention aims at providing a folding seat in which the backrest angle thereof is adjustable. Therefore, the folding seat provided by the present invention comprises a seating portion and is characterized in that the seating portion comprises a seating panel, a first footstand, a movable stand, a second footstand, a first pull rod and a second pull rod, wherein the upper end of the first footstand is hinged to the seating panel and is thus capable of rotating with regard to the hinged position relative to the seating panel; the movable stand is hinged to the seating panel and is thus capable of rotating with regard to the hinged position relative to the seating panel; the upper end of the second footstand is hinged to the free end of the movable stand and is thus capable of rotating with regard to the hinged position relative to the movable stand; both ends of the first pull rod are hinged to the first footstand and the movable stand respectively, so that the movable stand and the first footstand cooperatively rotate under the constraint of the seating panel and the first pull rod; and both ends of the second pull rod are hinged to the seating portion and the second footstand respectively, so that the second footstand and the seating panel cooperatively rotate under the constraint of the movable stand and the second pull rod.

As a preferred embodiment, the first footstand comprises a first support leg and a second support leg, wherein the upper end of the first support leg is hinged to a first hinged position of the seating portion, and the upper end of the second support leg is hinged to a second hinged position of the seating portion. The movable stand comprises a first movable rod and a second movable rod, wherein the hinged end of the first movable rod is hinged to a third hinged position of the seating portion. The hinged end of the second movable rod is hinged to a fourth hinged position of the seating portion. A straight line defined by the third hinged position and the fourth hinged position is parallel to a straight line defined by the first hinged position and the second hinged position. A third reinforcing rod is connected between the first movable rod and the second movable rod. The second footstand comprises a third support leg and a fourth support leg, wherein the upper end of the third support leg is hinged to a fifth hinged position of the first movable rod, and the upper end of the fourth support leg is hinged to a sixth hinged position of the second movable rod. A straight line defined by the fifth hinged position and the sixth hinged position is parallel to a straight line defined by the third hinged position and the fourth hinged position. One end of the first pull rod is hinged to a seventh hinged position of the first movable rod, and another end of the first pull rod is hinged to an eighth hinged position of the first support leg. One end of the second pull rod is hinged to a ninth hinged position of the seating portion, and another end of the second pull rod is hinged to a tenth hinged position of the third support leg. The folding seat further comprises a third pull rod and a fourth pull rod, wherein one end of the third pull rod is hinged to an eleventh hinged position of the second movable rod, and another end of the third pull rod is hinged to a twelfth hinged position of the second support leg. One end of the fourth pull rod is hinged to a thirteen hinged position of the seating portion, and another end of the fourth pull rod is hinged to a fourteen hinged position of the fourth support leg. The third pull rod is parallel to the first pull rod and has the length the same as that of the first pull rod. The fourth pull rod is parallel to the second pull rod and has the length the same as that of the second pull rod.

As a preferred embodiment, the first footstand comprises a first support leg, a second support leg and a first reinforcing rod, wherein both ends of the first reinforcing rod are fixed to the first support leg and the second support leg respectively. The upper end of the first support leg is hinged to a first hinged position of the seating portion, and the upper end of the second support leg is hinged to a second hinged position of the seating portion. The movable stand comprises a first movable rod and a second movable rod, wherein the hinged end of the first movable rod is hinged to a third hinged position of the seating portion. The hinged end of the second movable rod is hinged to a fourth hinged position of the seating portion. A straight line defined by the third hinged position and the fourth hinged position is parallel to a straight line defined by the first hinged position and the second hinged position. A third reinforcing rod is connected between the first movable rod and the second movable rod. The second footstand comprises a third support leg, a fourth support leg and a second reinforcing rod, wherein both ends of the second reinforcing rod are fixed to the third support leg and the fourth support leg respectively. The upper end of the third support leg is hinged to a fifth hinged position of the first movable rod. The upper end of the fourth support leg is hinged to a sixth hinged position of the second movable rod. A straight line defined by the fifth hinged position and the sixth hinged position is parallel to a straight line defined by the third hinged position and the fourth hinged position. One end of the first pull rod is hinged to a seventh hinged position of the first movable rod, and another end of the first pull rod is hinged to an eighth hinged position of the first footstand. One end of the second pull rod is hinged to a ninth hinged position of the seating portion, and another end of the second pull rod is hinged to a tenth hinged position of the second footstand.

As a preferred embodiment, the folding seat also comprises a backrest portion against which a person leans, wherein the bottom of the backrest portion is hinged to the seating portion, so that the backrest portion is capable of rotating relative to the seating portion.

As a preferred embodiment, the folding seat also comprises an undercarriage which is configured to adjust the angle of the backrest portion relative to the seating portion, wherein the undercarriage comprises a vertical portion which is rotatably connected to the backrest portion and is thus capable of rotating relative to the backrest portion. The folding seat further comprises a regulating box which is installed on the seating portion. The free end of the vertical portion of the undercarriage can be inserted into the regulating box and is fixed or released by the regulating box, and thus the rotating angle of the backrest portion relative to the seating portion can be controlled.

As a preferred embodiment, there is undercarriage hole in an upper cover and a lower bottom of the regulating box respectively for the vertical portion of the undercarriage to pass through. The vertical portion of the undercarriage has a plurality of notches, and the regulating box has a chuck which is configured to be clamped into the corresponding notch to so that the position of the undercarriage is fixed. The width of each of the undercarriage holes is slightly greater than that of the vertical portion of the undercarriage, and the undercarriage hole has enough length for allowing the vertical portion of the undercarriage to swing along with the rotation of the backrest portion.

As a preferred embodiment, the folding seat also comprises a handle one end of which is inserted into the regulating box and fixedly connected with the chuck and the other end of which extends out of the regulating box.

As a preferred embodiment, the folding seat also comprises a spring assembly configured to alleviate the impact force while the angle of the backrest portion is adjusted. The spring assembly comprises a spring shaft and a main spring. One end of the spring shaft is rotatably connected to the backrest portion and is parallel to the vertical portion of the undercarriage, and another end of the spring shaft is a free end and can be inserted into the regulating box. The main spring is sheathed outside the spring shaft. When the included angle between the backrest portion and the seating portion is larger than a preset angle, both ends of the main spring are compressed by the backrest portion and the regulating box respectively.

As a preferred embodiment, a baffle plate vertically extends out inwards/outwards from the side edge, oriented to the corresponding notch, of the undercarriage hole in an upper cover or a lower bottom of the regulating box and the baffle plate is configured to prevent the upper cover or the lower bottom of the regulating box from getting stuck by the notch.

As a preferred embodiment, the regulating box is equipped with a reset spring. One end of the reset spring is fixedly connected with the chuck for resetting the chuck to a position where the chuck is clamped with the corresponding notch.

Therefore, by implementing the present invention, a folding seat which is adjustable in backrest angle is obtained, which may, if necessary, act as a stretcher by adjusting the angle between a backrest and a seating panel to 180 degrees.

DETAILED DESCRIPTION OF THE PREFERRED EMBODIMENTS

Figure 1:
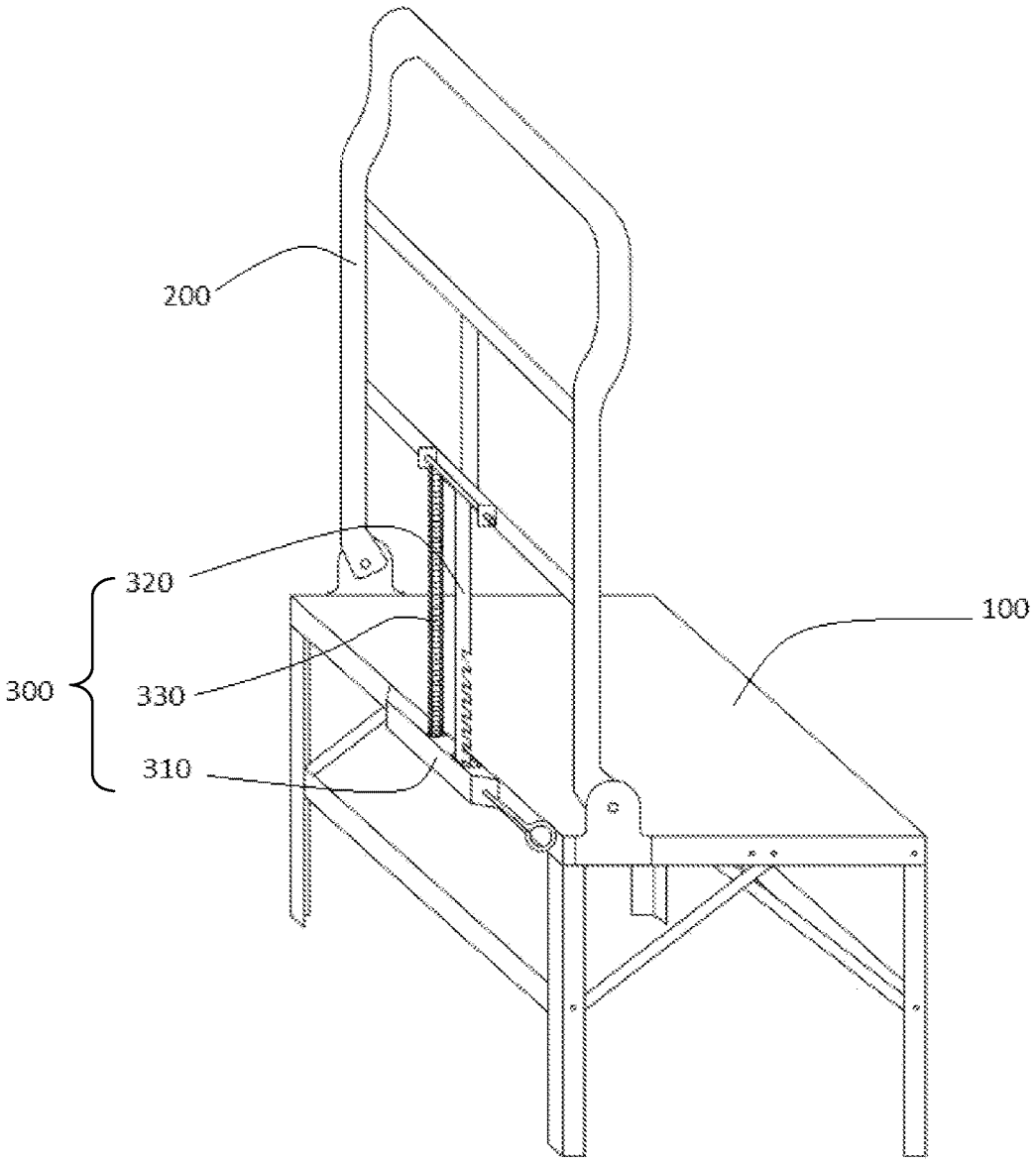
FIG. 1 is a structural diagram of the folding seat of the present invention.

By reference to FIG. 1, the folding seat of the present invention mainly comprises a seating portion 100, a backrest portion 200 and a regulating portion 300.

Figure 2:
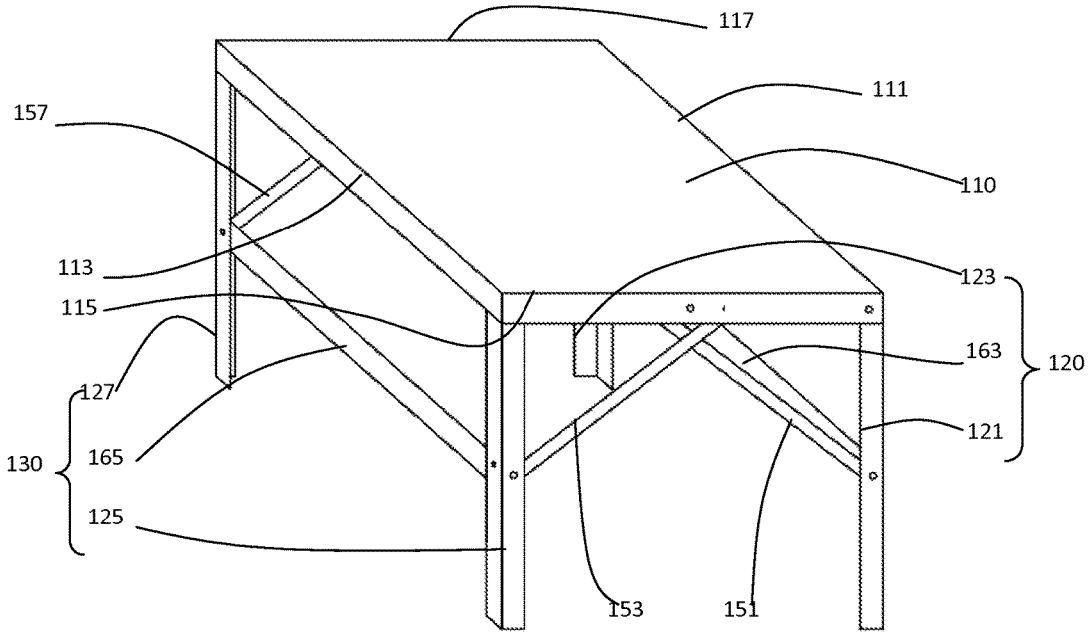
FIG. 2 is a structural diagram of the seating portion of the folding seat of FIG. 1 in a using state.
Figure 3:
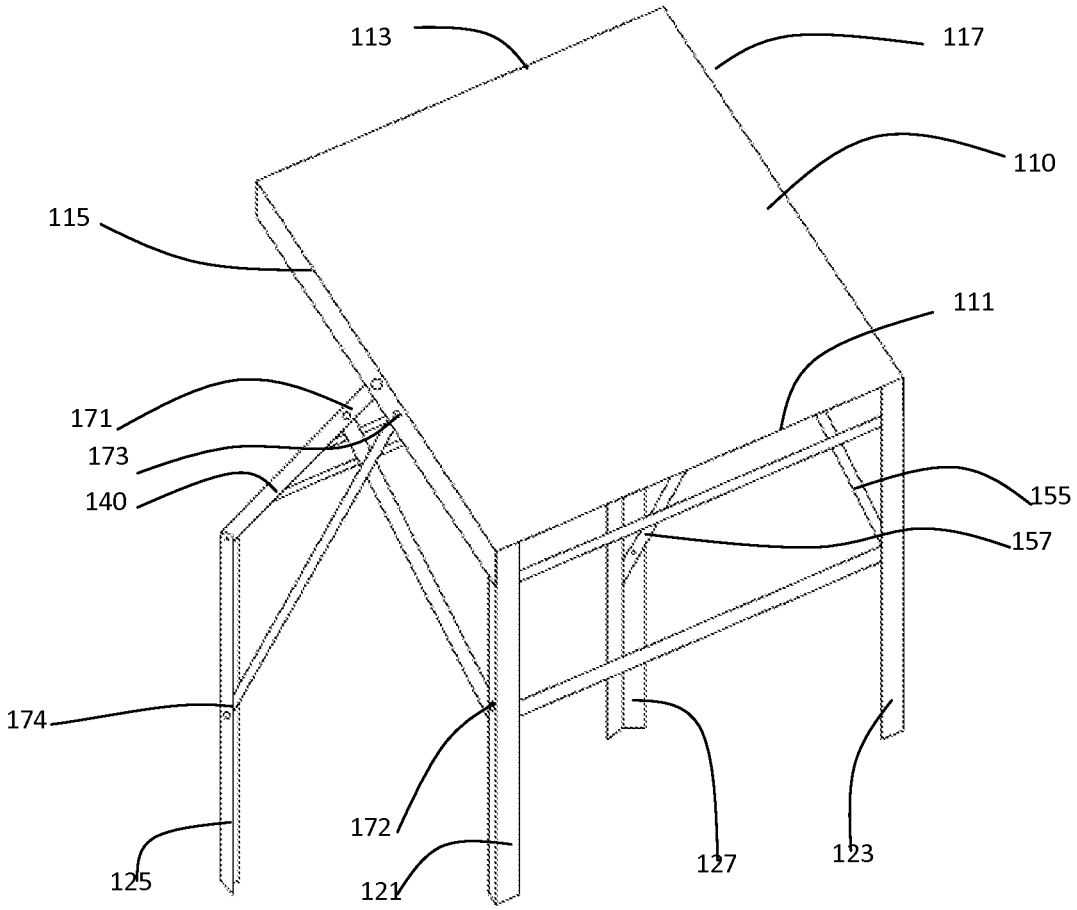
FIG. 3 is a structural diagram of the seating portion of FIG. 2 in a semi-folded state.
Figure 4:
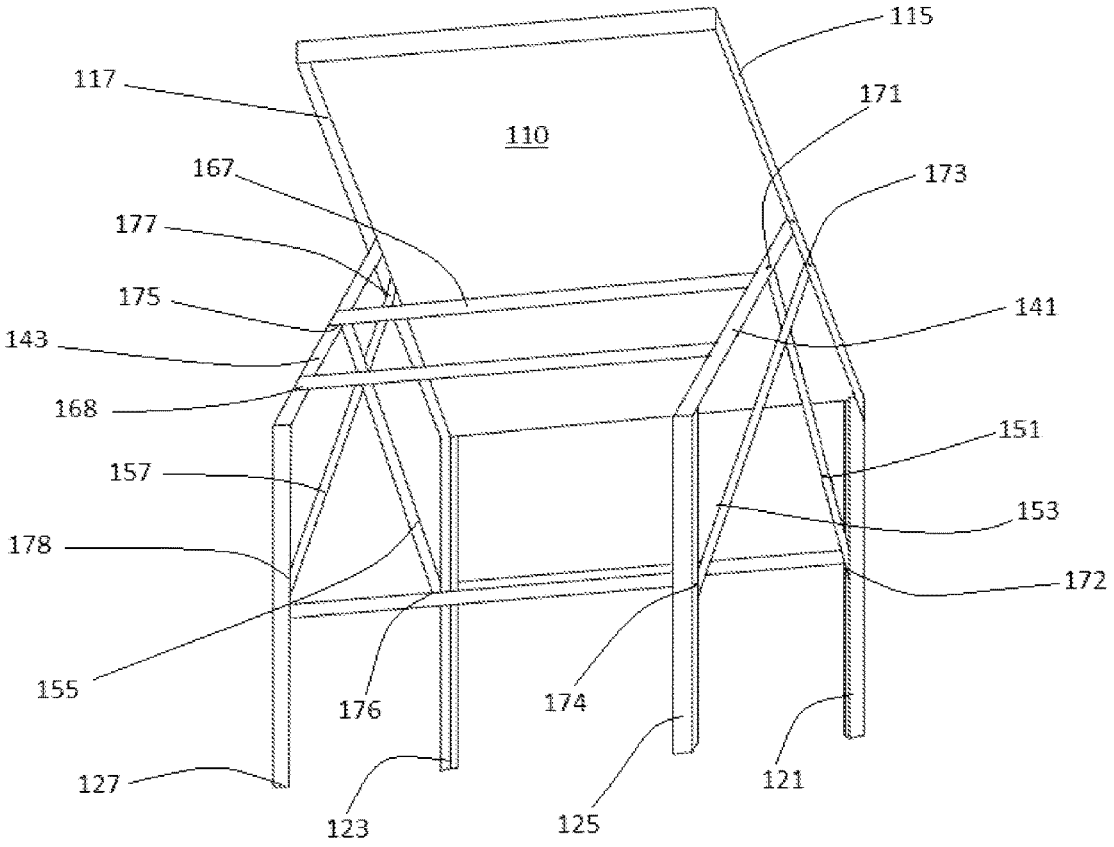
FIG. 4 is a structural diagram of the seating portion of FIG. 2 in a semi-folded state.
Figure 5:
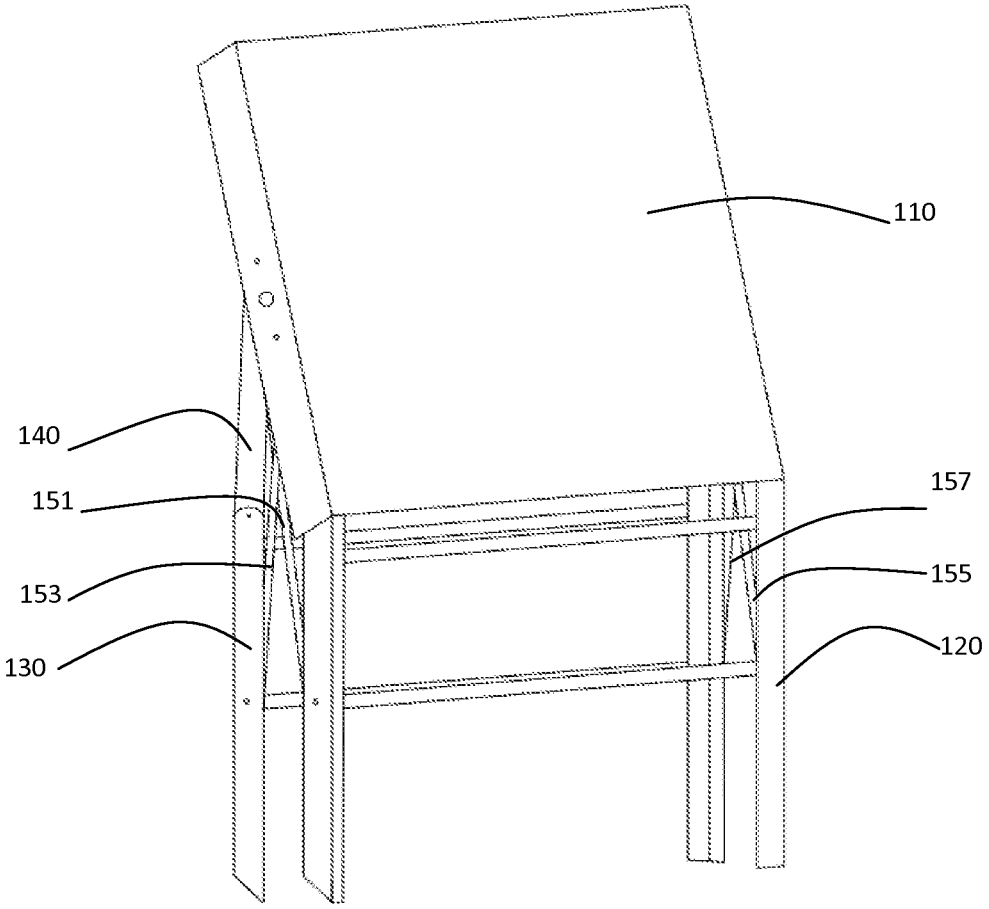
FIG. 5 is a structural diagram of the seating portion of FIG. 2 at a completely folded state.
Figure 6:
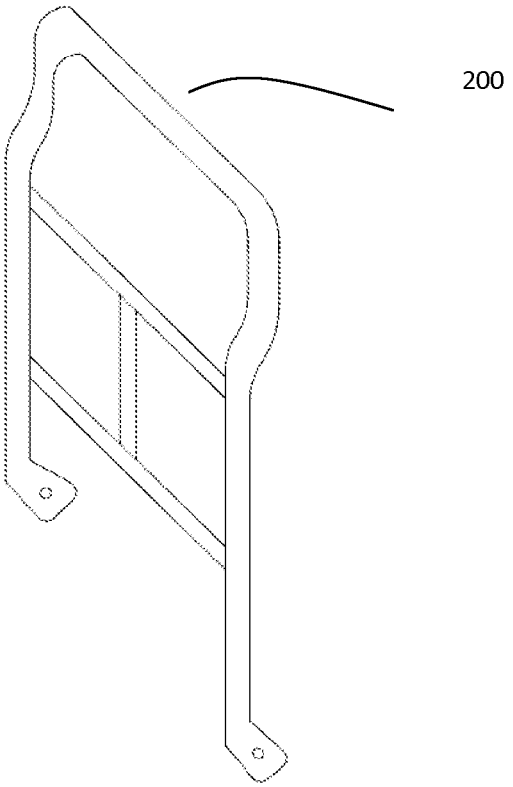
FIG. 6 is a structural diagram of the backrest portion of the folding seat as shown in FIG. 1.

By reference to FIGS. 2-4, the seating portion 100 comprises a seating panel 110, a first footstand 120, a second footstand 130 and a movable stand 140. The first footstand 120 comprises a first support leg 121 and a second support leg 123, wherein the upper end of the first support leg 121 and the upper end of the second support leg 123 are hinged to a first hinged position and a second hinged position of the seating portion 100 respectively. In this embodiment, the first hinged position and the second hinged position are located at a first side edge 111 of the seating portion 100, but the present invention is not limited to this embodiment. Preferably, the first hinged position and the second hinged position are respectively located at both ends of the first side edge 111 or positions close to both ends of the first side edge 111. The first support leg 121 and the second support leg 123 are fixedly connected through a first reinforcing rod 163, and the first reinforcing rod 163 is basically perpendicular to the first support leg 121 and the second support leg 123. Therefore, the first footstand 120 is H-shaped or is of an H-shape with narrow top and wide bottom, and is capable of rotating relative to the seating panel 110 around a straight line defined by the first hinged position and the second hinged position.

When the folding seat is at an unfolded state, the second footstand 130 is configured to support a second side edge 113 of the bottom of the seating panel 110. In this embodiment, the first side edge 111 and the second side edge 113 are opposite and are parallel with each other. The second footstand 130 comprises a third support leg 125 and a fourth support leg 127 which are configured to support on the ground. Similarly, the third support leg 125 and the fourth support leg 127 are fixedly connected through a second reinforcing rod 165, and the second reinforcing rod 165 is basically perpendicular to the third support leg 125 and the fourth support leg 127. Therefore, the second footstand 130 is also H-shaped or is of an H-shape with narrow top and wide bottom and is capable of moving relative to the seating panel 110.

Under the circumstance of higher footstands, another reinforcing rod parallel to the first reinforcing rod 163 may be added between the first support leg 121 and the second support leg 123; and similarly, another reinforcing rod parallel to the second reinforcing rod 165 may be added between the third support leg 125 and the fourth support leg 127 so as to reinforce the structure. The movable stand 140 is designed for folding the seating portion 100 conveniently, and is configured to connect the second footstand 130 to the seating panel 110. and the movable stand 140 comprises a first movable rod 141 and a second movable rod 143, wherein one end of the first movable rod 141 is hinged to a third hinged position of the seating portion 100, and in this embodiment, the third hinged position is located at a position near the middle of a third side edge 115 of the seating portion 100. One end of the second movable rod 143 is hinged to a fourth hinged position of the seating portion 100, and in this embodiment, the fourth hinged position is located at a position near the middle of a fourth side edge 117 of the seating portion. In this embodiment, the third side edge 115 and the fourth side edge 117 of the seating panel 110 are basically parallel with each other, and the first movable rod 141 and the second movable rod 143 are basically parallel with each other. Preferably, a third reinforcing rod 167 is fixedly connected between the first movable rod 141 and the second movable rod 143 and the third reinforcing rod 167 is basically perpendicular to the first movable rod 141 and the second movable rod 143. Therefore, the third reinforcing rod 167, the first movable rod 141 and the second movable rod 143 form an H shape and the integration thereof are capable of rotating relative to the seating panel 110.

As an optional embodiment, one or multiple reinforcing rods 167 may be added between the first movable rod 141 and the second movable rod 143. For instance, in this embodiment, two reinforcing rods 167 and 168 are added between the first movable rod 141 and the second movable rod 143. The two reinforcing rods which are spaced by a certain distance and are basically parallel with each other constitute a ⌸ shape together with the first movable rod 141 and the second movable rod 143.

The upper end of the third support leg 125 is hinged to a fifth hinged position of the first movable rod 141, and the lower end of the third support leg 125 is configured to be on the ground. The upper end of the fourth support leg 127 is hinged to a sixth hinged position of the second movable rod 143, and the lower end of the fourth support leg 127 is configured to be on the ground. Therefore, the second footstand 130 is capable of rotating relative to the movable stand 140/the seating panel 110 around a straight line defined by the fifth hinged position and the sixth hinged position. The straight line defined by the fifth hinged position and the sixth hinged position is basically parallel to the straight line defined by the third hinged position and the fourth hinged position.

As stated above, because the first footstand 120 is capable of rotating relative to the seating panel 110, the movable stand 140 is capable of rotating relative to the seating panel 110, and the second footstand 130 is hinged to the free end of the movable stand 140 and is capable of rotating relative to the movable stand 140. Thus, the second footstand 130 is capable of getting close to the first footstand 120 and is finally clung to the first footstand 120 in a folding process (refer to FIG. 4), and at this moment, the movable stand 140 also rotates approximately 180 degrees and is clung to the seating panel 110.

For the purpose of controlling and coordinating the relative position relationship and the movement process of the first footstand 120, the second footstand 130 and the movable stand 140, the folding seat is also equipped with a plurality of pull rods configured to connect the first footstand 120, the second footstand 130 and the movable stand 140.

Wherein, one end of the first pull rod 151 is connected to a seventh hinged position 171 of the first movable rod 141 of the movable stand 140, and the other end of the first pull rod 151 is connected to an eighth hinged position 172 of the first support leg 121. Therefore, the first movable rod 141, the seating panel 110, the first support leg 121 and the first pull rod 151 are connected to form a quadrangle (refer to FIG. 4), and the relative movement of the four aforesaid components is constrained by the side length of the quadrangle. For instance, when the first movable rod 141 of the movable stand 140 rotates relative to the seating panel 110, the first support leg 121 will be driven by the first pull rod 151 to rotate relative to the seating panel 110.

One end of the second pull rod 153 is hinged to a ninth hinged position 173 of a third side edge 115 of the seating panel 110, and the other end of the second pull rod 153 is hinged to a tenth hinged position 174 of the third support leg 125. Therefore, the first movable rod 141, the seating panel 110, the third support leg 125 and the second pull rod 153 are connected to form a quadrangle, and the relative movement of the four aforesaid components is constrained by the side length of the quadrangle. For instance, when the first movable rod 141 of the movable stand 140 rotates relative to the seating panel 110, the third support leg 125 will be driven by the second pull rod 153 to rotate relative to the first movable rod 141.

As stated above, the first footstand 120 is an H-shape as a whole, and thus the second support leg 123 and the first support leg 121 move synchronously. Similarly, the fourth support leg 127 and the third support leg 125 of the second footstand 130 move synchronously, and the second movable rod 143 and the first movable rod 141 of the movable stand 140 move synchronously. Therefore, the aforesaid first pull rod 151 is actually capable of constraining the relative movement of the whole movable stand 140, the whole first footstand 120 and the seating panel 110; and similarly, the aforesaid second pull rod 153 is capable of constraining the relative movement of the whole movable stand 140, the whole second footstand 130 and the seating panel 110.

It should be noted that a third pull rod 155 and a fourth pull rod 157 may be also added to enhance the constraint relationship forementioned. In this embodiment, one end of the third pull rod 155 is connected with an eleventh hinged position 175 of the second movable rod 143, and the other end of the third pull rod 155 is connected with a twelfth hinged position 176 of the second support leg 123. The third pull rod 155 is basically parallel to the first pull rod 151 and has a function similar to that of the first pull rod 151. One end of the four pull rod 157 is hinged to a thirteenth hinged position 177 of the fourth side edge 117 of the seating panel, and the other end of the four pull rod 157 is hinged to a fourteenth hinged position 178 of the fourth support leg. The fourth pull rod 157 is basically parallel to the second pull rod 153 and has a function similar to that of the second pull rod 153.

The seating panel 110, the first footstand 120 and the second footstand 130 form a support bracket, and the first pull rod 151 and the second pull rod 153 are used to respectively constrain the support bracket composed of the seating panel and the footstands so as to fix the seating portion 100.

By reference to FIG. 1, the adjusting portion 300 comprises a regulating box 310 and an undercarriage 320, wherein the regulating box 310 is configured to adjust the backrest angle. The regulating box 310 is installed on the outer surface of the second side edge 113 of the seating panel 110. One end of the undercarriage 320 is hinged to a backrest portion 200 and the other end of the undercarriage 320 is inserted into the regulating box 310. It should be noted that the larger the angle formed by the backrest portion 200 and the seating panel 110 is, the longer the length that the undercarriage 320 extends into the regulating box 310. The regulating box 310 is equipped with a device which is able to lock the embedded length of the undercarriage 320, so that the rotating angle of the backrest portion 200 relative to the seating panel 110 is fixed.

In this embodiment, the regulating portion 300 further comprises a spring assembly 330. Preferably, the spring assembly 330 is generally at a compressed state. When a user needs to adjust the angle formed by the backrest portion 200 and the seating panel 110, the rotating direction of the backrest portion 200 is the same as the gravity direction, and at this moment, the spring assembly 300 is further compressed to prevent the backrest portion 200 from dropping too fast. When a user needs to reduce the angle formed by the backrest portion 200 and the seating panel 110, the rotating direction of the backrest portion 200 is opposite to the gravity direction and is the same as the elastic force direction of the spring assembly 330, i.e., the spring assembly 330 supplies the boosting force.

Figure 7:
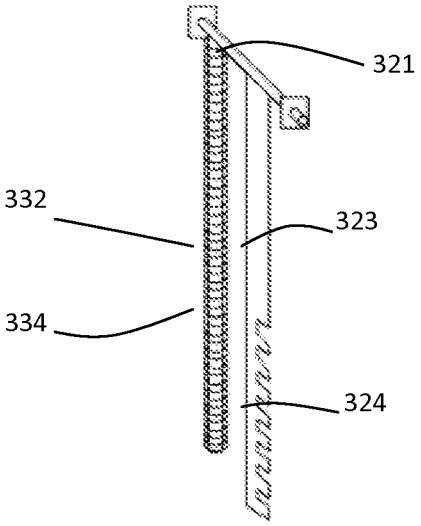
FIG. 7 is a structural diagram of the regulating portion of the folding seat of FIG. 1 except the regulating box.

By reference to FIG. 1 and FIG. 7, the undercarriage 320 is approximately T-shaped, which comprises a crossbeam 321 and a bolt 323 perpendicularly connected to the crossbeam 321, wherein the lower end of the bolt 323 has a plurality of notches 324. Preferably, the bolt 323 is flat. The spring assembly 330 comprises a spring pillar 332 and a main spring 334 sheathed on the spring pillar 332. The spring pillar 332 is also perpendicularly connected to the crossbeam 321 and is parallel to the bolt 323. The spring pillar 332 is mainly configured to prevent the main spring 334 from bending. As an embodiment, the lower edges of two notches 324 in the topmost end are inclined downwards from inside to outside, so that its maximum angle may be automatically reduced.

Figure 8:
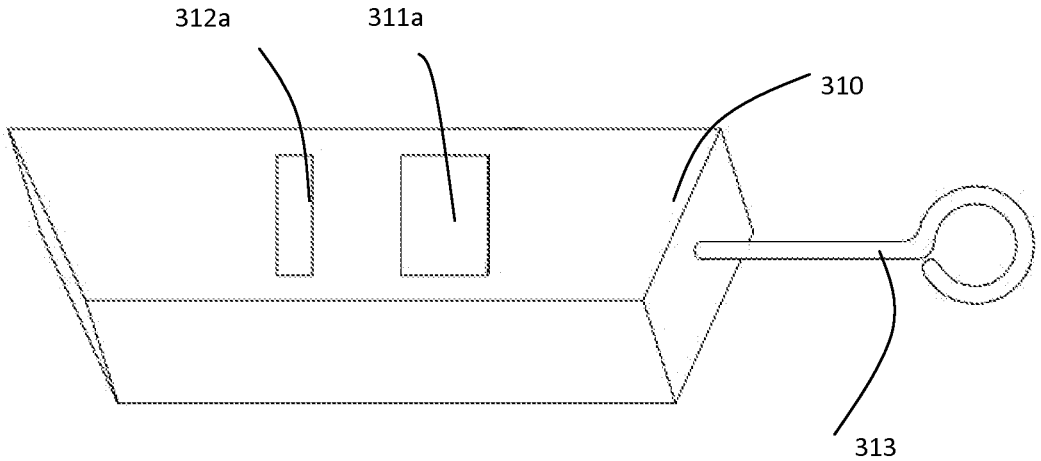
FIG. 8 is a structural diagram of the regulating box of the folding seat of FIG. 1.
Figure 9:
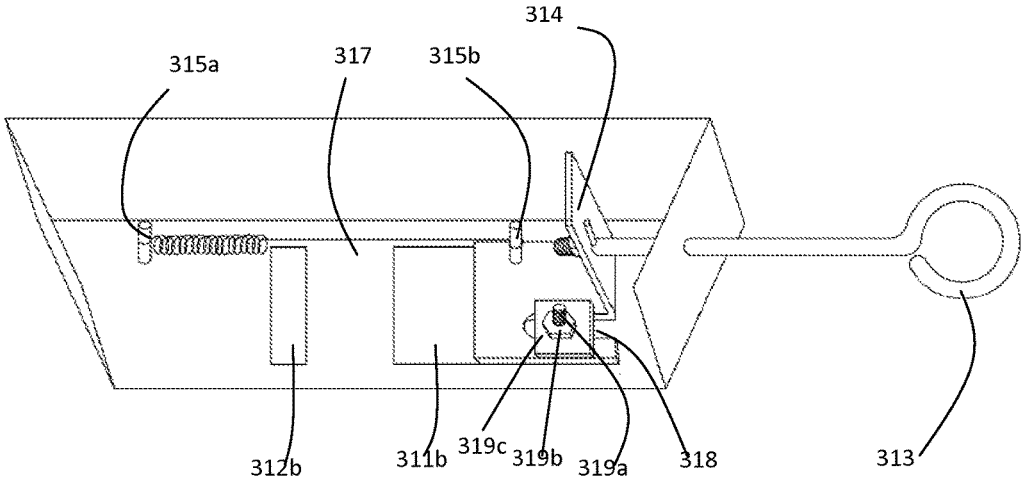
FIG. 9 is an internal structural diagram of the regulating box of FIG. 8.
Figure 10:
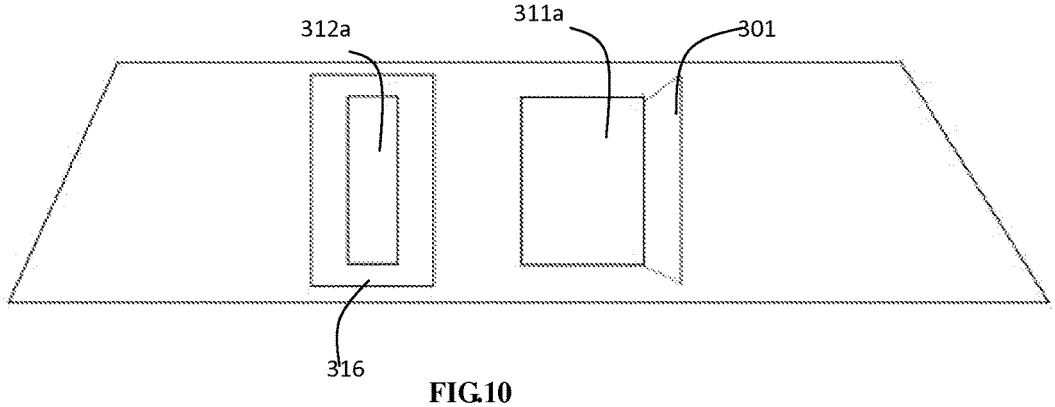
FIG. 10 is an internal structural diagram of the upper surface of the regulating box of FIG. 8.

By reference to FIG. 8 to FIG. 10, an upper cover of a handle regulating box 310 has an undercarriage hole 311*a* for the bolt 323 of the undercarriage 320 to pass through, and a hole 312*a* for the spring pillar 332 to pass through. The width of the undercarriage hole 311*a* is slightly greater than the width (the bolt size in the indentation direction of the notches 324) of the bolt 323, and the width of the hole 312*a* is slightly greater than the outer diameter of the spring pillar 332. Similarly, the lower bottom of the regulating box 310 has an undercarriage hole 311*b* for the bolt 323 of the undercarriage 320 to pass through, and a hole 312*b* for the spring pillar 323 to pass through. The holes 311*a* and 311*b* have a certain length along the rotating direction of the backrest portion 200, so that the lower end of the undercarriage 320 can swing in the undercarriage holes 311*a* and the 311*b* in the rotating process of the backrest portion 200.

It should be noted that the lower end of the main spring 334 should not penetrate through the regulating box 310 for the purposes of alleviating the impact force when the angle of the backrest portion is adjusted and ensuring the safety of the user. In this embodiment, the lower end of the main spring 334 is arranged on the upper cover of the regulating box 310, and the width of a spring shaft hole 312*a* is less than the diameter of the main spring 334 so as to prevent the main spring 334 from penetrating through the spring shaft hole 312*a*. The length of each of the spring shaft holes 312*a* and 312*b* is greater than the diameter of a spring shaft 332, so that the spring shaft 332 is capable of swinging at a small amplitude with the rotation of the backrest portion 200. Preferably, a reinforcing plate 316 configured to reinforce the structure is arranged on one side or the periphery of the hole 312*a* on the upper cover of the regulating box 310.

There is a baffle plate 301 vertically extended inwards/outwards from the side edge of the undercarriage holes 311*a* and/or 311*b* of the upper cover and/or the lower bottom of the regulating box 310, and for the lower bottom of the regulating box 310, the baffle plate 301 only vertically extends outwards. The baffle plate 301 is used to prevent the upper cover and/or the lower bottom of the regulating box 310 from being getting stuck by the notches 324. Preferably, the baffle plate is disposed within the regulating box 310.

By reference to FIG. 8 and FIG. 9, a handle 313 which is configured to fix the insertion position of the bolt 322 of the undercarriage 320 is installed on one side edge of the regulating box 310. One end, which is inserted into the regulating box 310, of the handle 313 is fixedly connected with a chuck 314. The chuck 314 is inserted into one of the notches 324 under the pushing of the handle 313 so as to fix the position of the undercarriage 320. There is a protruded first cylinder 315*a* on the inner surface of the bottom of the regulating box 310, and there is a protruded second cylinder 315*b* on the upper surface of the chuck 314. The first cylinder 315*a* and the second cylinder 315*b* are connected through a restoring spring 317, wherein the restoring spring 317 applies a force, opposite to the direction of the force by pulling the handle 313, to the chuck 314, and the elastic force generated by the restoring spring 317 makes the chuck 314 to be always stably clamped and locked with the notch of the bolt 322 so as to ensure stability of the regulating box 310. When the backrest portion 200 needs to be rotated again, the handle 313 can be pulled outwards by using hands, and then the locking between the chuck 314 and the bolt 322 can be released. There is a long and narrow U-shaped hole 318 along the movement direction of the chuck 314. A limiting screw 319*a* is installed on the bottom of the regulating box 310 through a limiting nut 319*b*, and the limiting screw 319*a* penetrates through the U-shaped hole 318 and is used to limit the chuck 314 to move back and forth only along a single direction so as to ensure the stability of the integral structure of the regulating portion 300. The screw 319*a* is in loose fit to the nut 319*b*. There is a meson 319C between the nut 319*b* and the chuck 314. The function of the meson 319C is to restrict the up-down movement so that the range of movement of the chuck 314 is not too large.

In actual use of the folding seat provided by the present invention, the angle of the backrest portion can be adjusted through the regulating portion 300. For instance, when the folding seat is at a first state, the angle between the backrest portion 200 and the seating panel 110 is 90 degrees When the aforesaid angle needs to be increased by a small amplitude, the handle 313 can be pulled outwards, and at this moment, the chuck 314 is separated from the notch 324 of the undercarriage, and then the backrest portion 200 can be rotated backwards. Since the backrest portion 200 is hinged to the seating panel 110, the backrest portion 200 can freely rotates. The main spring 334 is further compressed to play a buffering role. The undercarriage 320 is inserted into the regulating box 310 downwards more deeply, and after a desired angle is reached, the handle 313 can be released so that the chuck 314 is clamped into the corresponding notch 324 in the current position under the action of the rest spring 317, and thus the backrest portion 200 is fixed. It should be noted that when the backrest portion 200 is rotated backwards, the undercarriage 320 and the lower end of the spring shaft 332 will be driven to swing. The larger the lengths of the undercarriage holes 311*a* and 311*b* and the holes 312*a* and 312*b* along the swing direction are, the larger the adjustable angle of the backrest portion 200 is. The angle between the backrest portion 200 and the seating panel 110 is 90-130 degrees generally. When a larger angle range is needed, for instance, using the folding seat as a stretcher, the backrest portion 200 can be rotated forwards first, so that the lower end of the undercarriage 320 and the lower end of the spring assembly 330 are separated from the regulating box 310, and then the backrest portion 200 can be bent backwards to 180 degrees.

When the folding seat needs to be folded, the backrest portion 200 is rotated forwards first, so that the undercarriage 320 and the spring assembly 330 are separated from the regulating box 310, and finally, the backrest portion 200 is clung to the seating panel 110. Next, the second side edge 113 of the seating panel 110 is uplift, and at this moment, the movable stand 140 is separated from the seating panel 110, the second footstand 130 gets close to the first footstand 120 under the action of the gravity and is finally clung to the first footstand 120. The seating portion 100 will then become a flat plate. At this moment, the first footstand 120, the second footstand 130, the movable stand 140, the backrest portion 200 and the seating panel 110 are basically on the same plane, and thus the whole folding seat is of a flat plate and can be stored in a small space.

It is clear to the persons of ordinary skills in the art that transformations and improvements may be made to the present invention but these transformations and improvements should fall into the protection scope of the present invention. Therefore, the protection scope of the present invention is defined by the claims.

What is claimed is:

1. A folding seat comprising a seating portion, wherein the seating portion comprises:

a seating panel;

a first footstand, wherein an upper end of the first footstand is hinged to the seating panel and is thus capable of rotating with regard to the hinged position and relative to the seating panel;

a movable stand which is hinged to said seating panel and is thus capable of rotating with regard to the hinged position and relative to the seating panel;

a second footstand, wherein an upper end of the second footstand is hinged to a free end of the movable stand and is thus capable of rotating with regard to the hinged position and relative to the movable stand;

a first pull rod, wherein one end of the first pull rod is hinged to the first footstand and the other is hinged to the movable stand, so that the movable stand and the first footstand cooperatively rotate under the constraint of the seating panel and the first pull rod;

a second pull rod, wherein one end of the second pull rod is hinged to the seating portion and the other is hinged to the second footstand, so that the second footstand and the seating panel cooperatively rotate under the constraint of the movable stand and the second pull rod;

and wherein the folding seat further comprises a backrest portion against which a person leans, a bottom of the backrest portion being hinged to the seating portion so that the backrest portion is able to rotate relative to the seating portion;

and wherein the folding seat also comprises an undercarriage which is configured to adjust an angle of the backrest portion relative to the seating portion, the undercarriage comprising a vertical portion which is rotatably connected to the backrest portion and is thus capable of rotating relative to the backrest portion;

the folding seat comprising a regulating box which is installed on the seating portion;

a free end of the vertical portion of the undercarriage can be inserted into the regulating box and is fixed or released by the regulating box, and thus an rotating angle of the backrest portion relative to the seating portion can be controlled;

and wherein there is an undercarriage hole in an upper cover and a lower bottom of the regulating box respectively for the vertical portion of the undercarriage to pass through;

the vertical portion of the undercarriage having a plurality of notches, and the regulating box having a chuck inside which is configured to be clamped into the notch so that the position of the undercarriage is fixed; and a width of each of the undercarriage hole being slightly greater than that of the vertical portion of the undercarriage, the undercarriage hole having enough length for allowing the vertical portion of the undercarriage to swing along with the rotation of the backrest portion.

2. The folding seat according to claim 1, wherein the first footstand comprises a first support leg and a second support leg, an upper end of the first support leg being hinged to a first hinged position of the seating portion, an upper end of the second support leg being hinged to a second hinged position of the seating portion;

the movable stand comprising a first movable rod and a second movable rod, an hinged end of the first movable rod being hinged to a third hinged position of the seating portion; an hinged end of the second movable rod being hinged to a fourth hinged position of the seating portion; a straight line defined by the third hinged position and the fourth hinged position being parallel to a straight line defined by the first hinged position and the second hinged position; a third reinforcing rod being connected between the first movable rod and the second movable rod; the second footstand comprising a third support leg and a fourth support leg, an upper end of the third support leg being hinged to a fifth hinged position of the first movable rod, an upper end of the fourth support leg being hinged to a sixth hinged position of the second movable rod, a straight line defined by the fifth hinged position and the sixth hinged position being parallel to a straight line defined by the third hinged position and the fourth hinged position;

one end of the first pull rod being hinged to a seventh hinged position of the first movable rod, and another end of the first pull rod being hinged to an eighth hinged position of the first support leg; one end of the second pull rod is hinged to a ninth hinged position of the seating portion, and another end of the second pull rod being hinged to a tenth hinged position of the third support leg;

the folding seat further comprising a third pull rod and a fourth pull rod, one end of the third pull rod being hinged to an eleventh hinged position of the second movable rod, and another end of the third pull rod being hinged to a twelfth hinged position of the second support leg; one end of the fourth pull rod being hinged to a thirteenth hinged position of the seating portion, and another end of said fourth pull rod being hinged to a fourteenth hinged position of the fourth support leg; the third pull rod being parallel to the first pull rod and having a length the same as that of the first pull rod, and the fourth pull rod being parallel to the second pull rod and having a length the same as that of the second pull rod.

3. The folding seat according to claim 1, wherein, the first footstand comprises a first support leg, a second support leg and a first reinforcing rod, both ends of the first reinforcing rod being fixed to the first support leg and the second support leg respectively, an upper end of the first support leg being hinged to a first hinged position of the seating portion, and an upper end of the second support leg being hinged to a second hinged position of the seating portion;

the movable stand comprising a first movable rod and a second movable rod, an hinged end of the first movable rod being hinged to a third hinged position of the seating portion; an hinged end of the second movable rod being hinged to a fourth hinged position of the seating portion; a straight line defined by the third hinged position and the fourth hinged position being parallel to a straight line defined by the first hinged position and the second hinged position, and a third reinforcing rod being connected between the first movable rod and the second movable rod; the second footstand comprising a third support leg, a fourth support leg and a second reinforcing rod, both ends of the second reinforcing rod being fixed to the third support leg and the fourth support leg respectively, an upper end of said third support leg being hinged to a fifth hinged position of the first movable rod, an upper end of the fourth support leg being hinged to a sixth hinged position of the second movable rod, and a straight line defined by the fifth hinged position and the sixth hinged position being parallel to a straight line defined by the third hinged position and the fourth hinged position;

one end of the first pull rod being hinged to a seventh hinged position of the first movable rod, and another end of the first pull rod being hinged to an eighth hinged position of the first footstand; and one end of the second pull rod being hinged to a ninth hinged position of the seating portion, and another end of the second pull rod being hinged to a tenth hinged position of the second footstand.

4. The folding seat according to claim 1, wherein, the folding seat also comprises a handle, one end of the handle being inserted into the regulating box and fixedly connected with the chuck and another end of the handle extending out of the regulating box.

5. The folding seat according to claim 1 further comprising a spring assembly configured to relieve impact force while the angle of the backrest portion is adjusted, wherein said spring assembly comprises a spring shaft and a main spring, one end of the spring shaft being rotatably connected to the backrest portion and being parallel to the vertical portion of the undercarriage, and another end of the spring shaft being a free end and can be inserted into the regulating box; and the main spring being sheathed outside the spring shaft, when an included angle between the backrest portion and the seating portion is larger than a preset angle, both ends of the main spring being compressed by the backrest portion and the regulating box respectively.

6. The folding seat according to claim 1, wherein, a baffle plate vertically extends out inwards from a side edge, oriented to the corresponding notch, of the undercarriage hole in an upper cover of the regulating box and the baffle plate is configured to prevent the regulating box from getting stuck by the notch.

7. The folding seat according to claim 1, wherein, the regulating box is equipped with a reset spring, one end of the reset spring being fixedly connected with the chuck for resetting the chuck to a position where the chuck is clamped with the notch.

* * * * *